United States Patent [19]

Audeh et al.

[11] 4,404,092

[45] Sep. 13, 1983

[54] DELAYED COKING PROCESS

[75] Inventors: Costandi A. Audeh, Princeton, N.J.; Tsoung-Yuan Yan, Philadelphia, Pa.

[73] Assignee: Mobil Oil Corporation, N.Y.

[21] Appl. No.: 348,483

[22] Filed: Feb. 12, 1982

[51] Int. Cl.[3] ..... C10G 9/14

[52] U.S. Cl. ..... 208/131; 208/106

[58] Field of Search ..... 208/106, 131

[56] References Cited

U.S. PATENT DOCUMENTS

| | | | |
|---|---|---|---|
| 2,005,118 | 6/1935 | Voorhees | 208/131 |
| 2,088,778 | 8/1937 | Dimmig | 196/47 |
| 2,240,160 | 4/1941 | Kaplan | 196/60 |
| 2,422,790 | 6/1947 | Lee et al. | 196/55 |
| 2,776,931 | 1/1957 | Chaney et al. | 196/55 |
| 3,498,906 | 3/1970 | Bogart et al. | 208/131 |
| 3,936,358 | 2/1976 | Little | 208/131 X |
| 4,085,034 | 4/1978 | Endo et al. | 208/48 |
| 4,100,035 | 7/1978 | Smith | 208/131 X |
| 4,108,798 | 8/1978 | Sze et al. | 208/131 X |
| 4,176,052 | 11/1979 | Bruce et al. | 208/131 |

*Primary Examiner*—Delbert E. Gantz
*Assistant Examiner*—Glenn A. Caldarola
*Attorney, Agent, or Firm*—Michael G. Gilman; Charles J. Speciale; L. G. Wise

[57] ABSTRACT

The liquid yield of a delayed coking process is improved by controlling the temperature of the vapor space above the carbonizing mass so that that incipient coking and cracking of the vapors is reduced. The temperature is preferably controlled by introducing a quenching liquid into the vapor space; suitable liquids for this purpose include water, coker feedstock and the bottoms fraction derived from the coker products.

7 Claims, 1 Drawing Figure

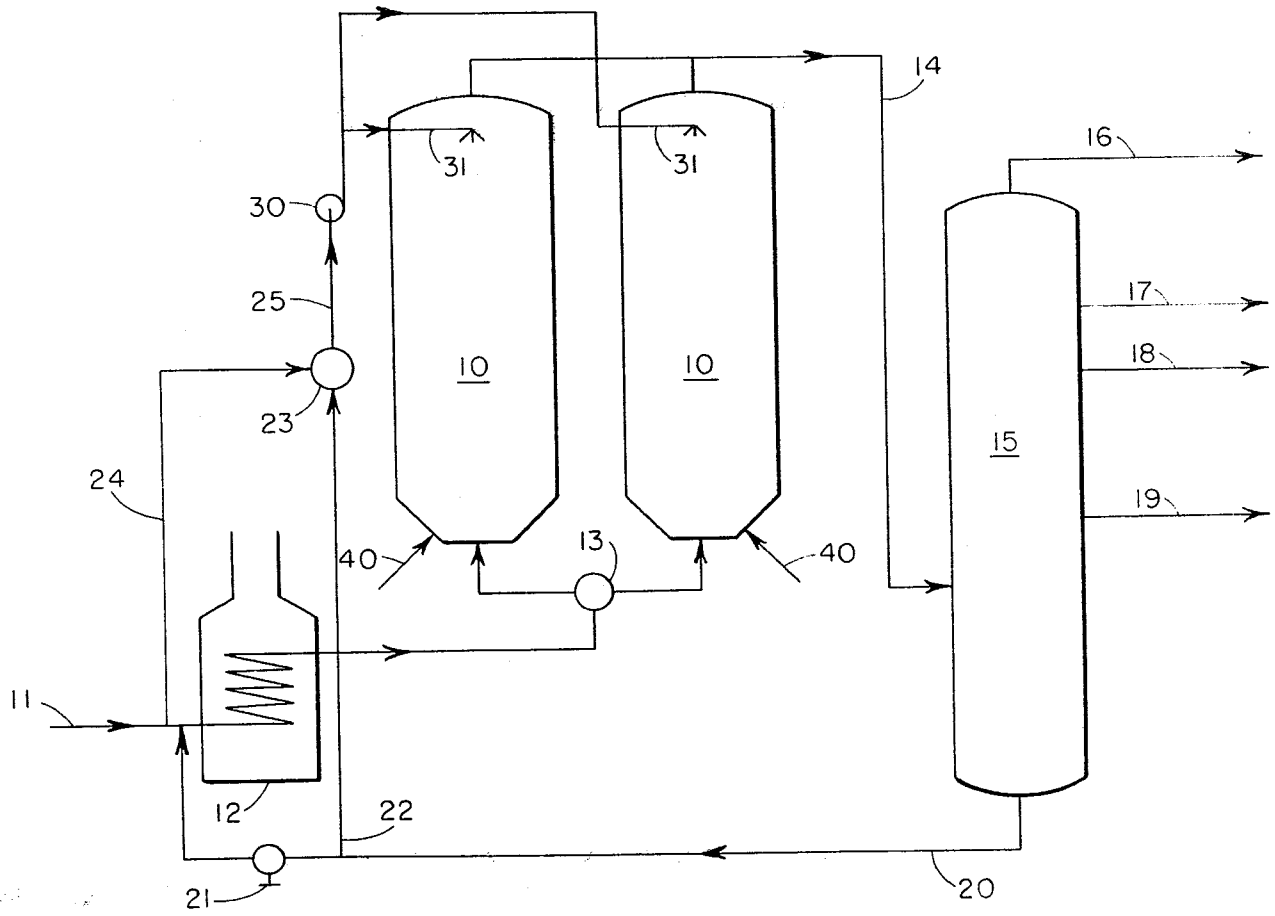
16
17
18
19
15
14
20
40
10
31
13
10
31
40
22
30
25
23
12
21
24
11

DELAYED COKING PROCESS

FIELD OF THE INVENTION

This invention relates to a delayed coking process which has an improved liquid yield.

THE PRIOR ART

The delayed coking process has been used in the petroleum refining industry for a considerable time. In this process, the heavy oil feed to the coker, usually the residue from an atmospheric or vacuum crude distillation tower, is heated rapidly in a heater from which it flows directly to an insulated drum where the coking or carbonizing reactions take place. Coking takes place in the carbonizing mass in the lower portion of the coker drum during the delayed residence of the heated feed in the drum, usually for a period of about twenty four hours. At the start of the coking reaction the drum is empty and it is gradually filled during the course of the coking reaction until the mass of coke approaches the top of the drum. The coking reaction takes place at temperatures of about 450° to 500° C. and under mildly elevated pressures, typically 100 to 1000 kPa. The temperature, pressure and other conditions are adjusted to maximize the yield of the desired liquid products which are formed during the reaction and which are removed by steam stripping as the reaction proceeds. At the end of the coking reaction, the coke which is left behind in the drum, is removed while the feed from the heater is switched to another drum.

The object of the coking process is to upgrade the residual feedstock and so to obtain relatively lighter products of greater value which are generally used as feedstock for catalytic cracking units e.g. a fluid catalytic cracker (FCC). To ensure that the liquid product from the coker is of suitable quality, the product from the coker is usually fractionated and the bottoms fraction, typically boiling above 370° C., is recycled. The recycle stream generally constitutes about one quarter of the fresh feed.

The coking reaction is principally a thermal cracking reaction which takes place at the relatively high temperatures prevailing in the coker drum. The cracking reactions do not, however, cease when the heavy residual feedstock has been converted to coke and lighter liquid products; because the same high temperatures prevail in the vapor space above the carbonizing mass in the drum, the vaporized liquid product tends to be cracked further and non-selectively to form even lighter products, including gas, resulting in an undesirable loss in liquid yield. Accordingly, it would be desirable to minimize the gas yield so as to obtain a greater quantity of liquid products for the processing units fed by the coker.

SUMMARY OF THE INVENTION

It has now been found that the liquid yield of the delayed coking process may be improved by controlling the temperature profile of the coking drum. When the temperature of the vapor phase in the coker drum is held below the incipient cracking temperature of the vapor, generally below 450° C., the undesirable secondary cracking of the vapors will be decreased because the cracking reactions which would otherwise occur in the vapor space above the carbonizing mass at the bottom of the drum are less favored, thereby permitting the desired liquid products to pass over in vapor form without further cracking the carbonizing mass in the lower portion of the coker. It is preferred that the temperature profile of the reactor should be controlled so that the vapor space is cooler at the top of the drum and hotter at the bottom, near the liquid/solid interface. It has been found that temperatures of 400° C. to 425° C. at the top of the vapor space will effectively control the incipient cracking of the hydrocarbon vapors but lower temperatures may, of course, be employed if they can be conveniently and economically attained.

The temperature profile of the coker may be controlled by various means. For example, a heat exchanger may be disposed in the upper part of the coker drum and a cooking liquid circulated through it. This will not, however, be generally favored because the exchanger will impedge removal of the coke. It has been found preferable to control the temperature profile by directly injecting liquid, in the form of a spray, from the top of the drum. Suitable liquids include water and coker feed, either fresh or recycle.

BRIEF DESCRIPTION OF THE DRAWINGS

The single FIGURE of the accompanying drawings is a flowsheet illustrating a delayed coking process using coker feed to control the temperature profile of the coker drum.

DESCRIPTION OF THE PREFERRED EMBODIMENTS

The delayed coking process of the present invention may suitably be carried out in a coking unit of the type shown in the FIGURE. In this unit, two coker drums 10 are provided in order to provide for continuous operation with coking taking place alternately in each drum. A greater number of drums may, of course, be used in order to provide the desired coking capacity. The drums will be equipped with the usual means for removing the coke which, being conventional, are not shown in the diagram. A feed line 11 connected to a source of heavy hydrocarbon coker feed passes through a heater furnace 12 where the feed is heated to the desired temperature for the coking process. From the heater the feed line passes to a switch valve 13 which permits the heated feed to flow to one drum or the other, depending upon which is currently being filled. The coker drums 10 are connected to common overhead line 14 which passes to fractionator 14. The gas overheads leave the fractionator by line 16 and other products such as light hydrocarbons ($C_3$–$C_4$) and gasoline from lines 17 and 18. These products may be passed to subsequent processing units such as a hydrodesulfurizer. The heavy gas oil product passes out through line 19 to be passed to the cracking unit. The bottoms fraction of the tower is removed through recycle line 20 which is connected to feed line 11 through recycle control valve 21.

A branch line 22 from recycle line 20 passes to a switching and regulator valve 23 which is also connected to feed line 11 by means of line 24. Valve 23 controls the relative proportions of oil passing from lines 22 and 24 to line 25 which is on the inlet side of the feed pump 30. The delivery side of pump 30 feeds spray heads 31 which are situated in coker drums 10.

Steam strippers 40 are provided in the conventional manner. Other conventional equipment such as surge tanks and separator drums is omitted from the diagram for clarity.

In operation, the coker feedstock mixed with steam is heated in furnace 12 to a suitable temperature for the coking reaction to proceed, generally above 450° C. and typically in the range of 450° C. to 500° C. The heated feed then proceeds to the bottom of one or the other of the coker drums which, at the start of the coking cycle, is empty. As the heated feedstock is fed into the bottom of the drum, the coking reaction proceeds and the level of the carbonizing mass in the drum rises. The feedstock is coked under the conditions prevailing in the drum, to produce the desired cracking products together with some gas and coke, which remain behind in the drum. During this time, the gases and vapors produced by the coking reaction leave the coking drum by the overhead line and pass to the fractionator for separation in the normal way. The coking cycle is continued until the coke level approaches the top of the coker; the cycle is then terminated, with the feed being transferred to the swing drum.

The temperature profile of the coker drum is controlled so as to minimize the cracking reactions which take place in the vapor space above the level of the carbonizing mass in the coker. The temperature of the vapor phase is generally below 450° C. and preferably below 425° C. It is preferred that the temperature profile in the drum should be controlled so that the vapor phase is cooler at the top of the drum and hotter at the bottom. At the interface of the vapor and the carbonizing mass the temperature should be no more than 450° C. and preferably below 425° C. Although lower temperatures may be tolerated in this region, e.g. 400° C., excessive cooling may tend to slow down the coking reaction, and for this reason may be undesirable. The temperature of the vapor phase at the top of the drum near the overhead exit may be cooler; exit temperatures of 425° C. or lower e.g. 400° C., will usually be effective to control the incipient cracking of the hydrocarbon vapors.

The temperature of the vapor phase in the coker may be maintained by various means. A heat exchanger may be provided in the upper portion of the drum so that a suitable coolant may be circulated through it. This method will normally not be favored because of its greater capital cost relative to other methods described below and also because the exchanger will tend to interfere with the removal of the coke.

The preferred method of heat control is by introducing a quenching liquid into the top of the coker, as shown in the FIGURE. In this case, the quenching liquid may be fresh feed, heavy coker bottoms from the fractionator or mixtures of the two, as determined by the setting of the regulator valve 23. The quench liquid is introduced into the coker by means of a spray head or heads 31 at the top of the drum, with suitable pressurization being provided by feed pump 30 to overcome the internal pressure of the coker and to provide the desired degree of atomization. Because the spray head is situated near the overheads exit, the droplet size of the spray should be controlled to minimize its carryover. The droplets of the quenching liquid scrub the vapors leaving the drum and effectively remove fine particles and the heavy ends, resulting in a coker product of improved quality.

The quantity of the quench stream used will depend both upon its nature and its initial temperature and can be calculated to achieve the desired degree of cooling. In order to avoid excessive cooling of the carbonizing mass in which the desired coking reaction is taking place, the quantity of the quenching stream and its droplet size should be controlled so that either the liquid mist completely evaporates before reaching the carbonizing mass interface or the droplets should have attained a temperature equivalent to that of the carbonizing mass. This temperature should not exceed 450° C., preferably not above 425° C. When coker feed is used for quenching its amount, whether fresh or recycle, will generally be from 5 to 30 weight percent, preferably 10 to 20 weight percent based on the total feed to the coker.

Water or steam may also be injected into the coker drum to control the temperature of the vapor phase, either alone or together with fresh or recycled coker feed. Water is an effective quenching liquid because of its high heat of vaporization and a high specific volume so that it further reduces the reactive vapor space available for the undesirable cracking reactions. Thus, because of the reduced volume available, the vapors of the liquid coking products will have a reduced residence time in the vapor space of the coker, further inhibiting the tendency for secondary cracking to occur. However, if steam is readily available it may be used as an alternative to water even though it has the disadvantage relative to water of not cooling by evaporation. The water or steam may be introduced into the coker drum by a spray system which is separate from but similar to the spray used for the coker feed so that both water or steam and coker feed may be used to control the temperature of the vapor phase. When water or steam are used, a steam knock-out drum may be interposed between the coker and the fractionator to remove the steam at this point.

If distillation tower bottoms recycle is used cool the vapor space, the recycle to coker feed line 11 may be wholly or partly eliminated thereby resulting in a relatively lower yield of coke and a higher yield of liquid. However, if only part of the recycle is used as quench stream, the remainder may pass through control valve 21 to feed line 11. This may be desired if a water or steam spray is used for all or part of the cooling.

There is a number of advantages to the present process. First, the liquid yield is improved both in quantity and quality and concomitantly, the yields of gas and coke are reduced. Second, the thermal efficiency of the process is increased with a net energy saving, particularly with high temperature, premium heat. Third, the necessary apparatus may be readily installed into existing equipment thus permitting integration into existing refineries and because the process increases coker capacity by reducing coking cycle time, the capacity of existing refineries can be readily increased in this way. Fourth, the coking conditions can be more readily controlled according to the feedstocks available. Finally, no foreign matter is introduced into the coking cycle thereby producing a purer liquid product together with a coke uncontaminated by undesirable impurities.

The invention is illustrated by the following Examples.

EXAMPLES 1-2

A small scale (74 ml) vertical coker was constructed from 22 mm (internal diameter) stainless steel tube. A stainless steel plug with a central aperture was used as a preheater section and a vapor outlet was provided at the top. Feed lines for coker feed and steam were connected to the bottom of the coker below the preheater plug. The vapor outlet was connected to a stainless steel receiver in which condensable products were disengaged from gas which could be passed to sampling equipment.

A vacuum tower residue feed stock was fed to the coker under atmospheric pressure (Example 1) or 377 kPa (Example 2) and at a temperature of 490° C., using 2 percent by weight of steam as stripper. The product yields are reported in Table 1 below.

TABLE 1

| | Example 1 | Example 2 |
|---|---|---|
| Coking temp., °C. | 490 | 490 |
| Pressure, kPa | 101 | 377 |
| Yield of Products (wt. %): | | |
| Gas | 7 | 10 |
| Liquid | 65 | 58 |
| Coke | 28 | 32 |

EXAMPLES 3-4

These two Examples illustrate the effect of increased residence time for the vapor in the coker.

A small scale coker similar to that used in Examples 1 and 2 was used but the size of the coker was increased to approximately 1270 ml by increasing the internal diameter to 67 mm and the length to 570 mm. The increased size of the coker provided an increased vapor residence time in the vapor space above the carbonizing mass.

The coking was carried out, as before, on the same liquid feed at atmospheric pressure (Example 3) or 377 kPa (Example 4), 490° C. coking temperature and with 2 percent by weight of steam as a stripper. The temperature of the vapor space was held at 454° C. The results are shown in Table 2 below.

TABLE 2

| | Example 3 | Example 4 |
|---|---|---|
| Coking temp., °C. | 490 | 490 |
| Pressure, kPa | 101 | 377 |
| Yield of products (wt. %): | | |
| Gas | 11 | 13 |
| Liquid | 61 | 57 |
| Coke | 28 | 30 |

Comparison of these results with those of Table 1 shows that the increased residence time of the vapors promotes secondary cracking with a consequently higher gas yield at the expense of liquid products.

EXAMPLE 5

This Example illustrates the effect of controlling the temperature of the vapor phase by injection of quenching liquid.

Coking was carried out as before, in the small scale coker used for Examples 1 and 2. The temperature profile of the coker was, however, controlled by the injection of water from the top of the coker. The amount of water injected was about 9 percent by weight of the feed and was sufficient to maintain the temperature of the vapor phase at 425° C. The coking in the solid/liquid phase took place at a temperature of 490° C. and at atmospheric pressure with 2 volume percent of steam in the feed as stripper.

The results, shown in Table 3 below, demonstrate that an improved liquid yield is obtained by suitable control of the temperature of the vapor phase below that of which incipient cracking and coking occurs (cf. Example 1).

TABLE 3

| | Example 5 |
|---|---|
| Coking temp., °C., | 490 |
| Pressure, kPa | 101 |
| Yield of Products (wt. %): | |
| Gas | 6 |
| Liquid | 72 |
| Coke | 22 |

We claim:

1. In a delayed coking process in which a heated heavy hydrocarbon feedstock is introduced into the bottom of a coker drum to form a carbonizing mass at a temperature of at least 450° C. in which the delayed coking reaction occurs to form coke and gas and vapor phase products which are removed from the vapor space above the carbonizing mass through an outlet the improvement which comprises: maintaining the temperature of the vapor space substantially below 450° C. by introducing a quenching liquid into the vapor space of the coker drum in the region of the outlet, whereby the temperature of vapor space is maintained at its lowest in the region of the outlet and at its highest in the region of the interface with the carbonizing mass and liquid products are obtained in improved yield.

2. A process according to claim 1 in which the temperature of the vapor space is maintained at about 425° C. in the region of the outlet.

3. A process according to claim 1 in which the temperature of the vapor space is maintained by introducing a quenching liquid comprising water into the vapor space of the coker drum in the region of the outlet.

4. A process according to claim 1 in which the temperature of the vapor space is maintained by introducing a quenching liquid comprising heavy hydrocarbon feedstock for the coking process into the vapor space of the coker drum in the region of the outlet.

5. A process according to claim 1 in which the temperature of the vapor space is maintained by introducing a quenching liquid comprising a bottoms fraction derived by fractionation of the vapor phase coker products into the vapor space of the coker drum in the region of the outlet.

6. A process according to claim 1 in which the temperature of the vapor space is maintained by introducing a quenching liquid comprising a mixture of a heavy hydrocarbon feedstock for the coking process and a bottoms fraction derived by fractionation of the vapor phase coker products into the vapor space of the coker drum in the region of the outlet.

7. A delayed coking process in which heated petroleum residua is introduced into a coking drum to form a carbonizing mass at a temperature of at least 450° C. to form coke and a vapor phase which is maintained at a temperature substantially equal to the carbonizing mass temperature in the region of the interface between the vapor phase and carbonizing mass;

withdrawing hot vapor from the coker drum through a vapor outlet above the carbonizing mass;

introducing quenching water into the vapor phase in the region of the vapor outlet to maintain an outlet vapor temperature below about 425° C. with progressively hotter temperature towards the carbonizing mass; and recovering liquid hydrocarbon products from the vapor phase in improved yield.

* * * * *

UNITED STATES PATENT AND TRADEMARK OFFICE

CERTIFICATE OF CORRECTION

PATENT NO. : 4,404,092

DATED : September 13, 1983

INVENTOR(S) : Costandi A. Audeh et al.

It is certified that error appears in the above-identified patent and that said Letters Patent is hereby corrected as shown below:

Column 6, claim 1, line 23, after "whereby" delete "the".

Column 6, claim 1, line 24, after "of" insert -- the --.

Signed and Sealed this

*Twenty-first* Day of *August 1984*

[SEAL]

*Attest:*

GERALD J. MOSSINGHOFF

*Attesting Officer*

*Commissioner of Patents and Trademarks*